United States Patent [19]

Rasch et al.

[11] Patent Number: 4,754,195

[45] Date of Patent: Jun. 28, 1988

[54] HIGH-PRESSURE DISCHARGE LAMP, AND METHOD OF ITS MANUFACTURE

[75] Inventors: Erhard Rasch, Ottobrunn; Jürgen Heider, Munich; Werner Eisele, Neu-Esting, all of Fed. Rep. of Germany

[73] Assignee: Patent-Treuhand-Gesellschaft für elektrische Glühlampen mbH, Munich, Fed. Rep. of Germany

[21] Appl. No.: 947,501

[22] Filed: Dec. 29, 1986

[30] Foreign Application Priority Data

Jan. 15, 1986 [DE] Fed. Rep. of Germany ..... 3600991

[51] Int. Cl.[4] ..... H01J 61/30

[52] U.S. Cl. ..... 313/626; 174/50.59; 174/124 R; 439/182; 313/318; 313/332; 313/334

[58] Field of Search ..... 313/318, 332, 580, 590, 313/623, 477 HC, 609, 626, 334; 439/182, 181, 619, 613, 614, 618; 174/50.5, 50.52, 50.59, 124 R

[56] References Cited

U.S. PATENT DOCUMENTS

| | | | |
|---|---|---|---|
| 3,934,067 | 1/1976 | Goldman et al. | 428/290 |
| 4,216,406 | 8/1980 | Bjorkman et al. | 313/318 X |
| 4,243,907 | 1/1981 | Kohl et al. | 313/318 |
| 4,542,316 | 9/1985 | Hall et al. | 313/318 |
| 4,568,854 | 2/1986 | Westlund, Jr. et al. | 313/579 |
| 4,570,104 | 2/1986 | Janssen et al. | 313/331 X |
| 4,631,446 | 12/1986 | English et al. | 313/634 |
| 4,658,177 | 4/1987 | Gosslar et al. | 313/25 X |

FOREIGN PATENT DOCUMENTS

| | | | |
|---|---|---|---|
| 60-124346 | 7/1985 | Japan | 313/318 |

*Primary Examiner*—David K. Moore
*Assistant Examiner*—Mark R. Powell
*Attorney, Agent, or Firm*—Frishauf, Holtz, Goodman & Woodward

[57] ABSTRACT

To improve the high-voltage flash-over characteristics of high-pressure discharge lamps (1), and especially to prevent flash-over between terminal leads emanating from the lamp bulb and extending into a lamp base (14), the lamp base which is formed with a cup-shaped opening (13) has an insert pad (18) placed therein of fibrous web, pile, fleece or mat material, made of ceramic, quartz or glass fibers. In manufacture, the fibers are compressed, thereby fitting tightly against the terminal end, typically a pinch or press seal, of the discharge lamp bulb, and thereby substantially increasing the high voltage flash-over resistance between the terminal leads and permitting hot re-ignition of the lamp, which may require pulses of between 15 to 20 kV.

11 Claims, 1 Drawing Sheet

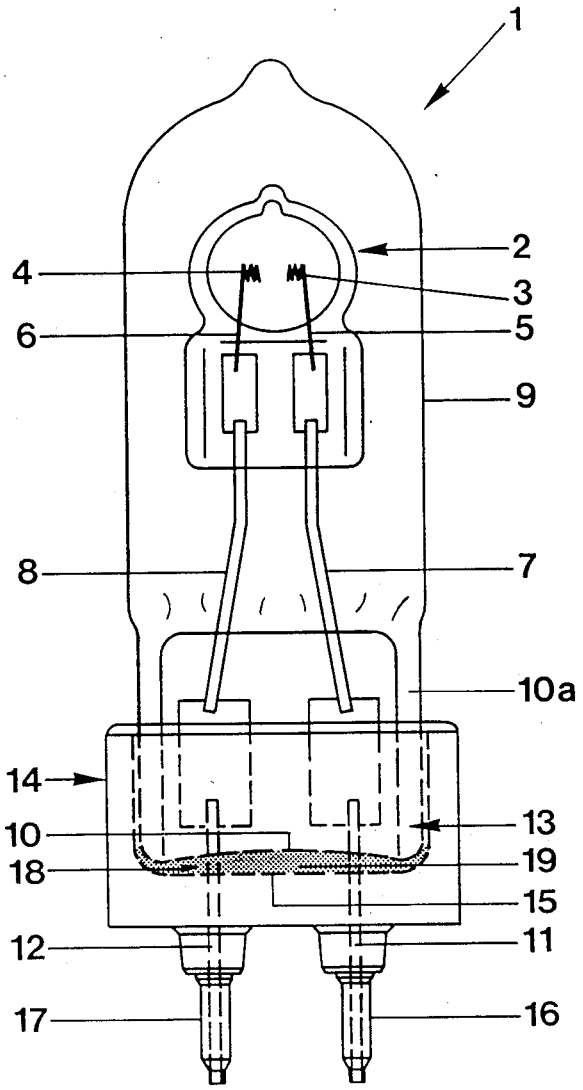
1
2
3
4
5
6
9
7
8
10a
14
13
10
19
18
15
12
11
17
16

HIGH-PRESSURE DISCHARGE LAMP, AND METHOD OF ITS MANUFACTURE

The present invention relates to high-pressure discharge lamps, and more particularly to a base structure and method of basing such a lamp.

BACKGROUND

Lamp bulbs, forming the actual light source, of high-pressure discharge lamps, are apt to become very hot. The light source base portion itself should be retained in a base structure which carries connecting terminals, such as terminal blades, pins or the like. Voltages arising in high-pressure discharge lamps, particularly metal halide discharge lamps, are high. Compact versions of metal halide discharge lamps, having power outputs in the order of about 100 W, frequently require ignition or firing while the lamps are still hot. Such lamps of 100 W power, usually, are single-ended, that is, are single-based with base terminals at one end portion of the lamp. Hot re-ignition requires use of a suitable ignition circuit which applies short-duration pulses in the order of about 20 kV. The exact value of ignition pulse voltage depends on the power rating and design of the lamp.

The high-voltage pulses required for hot re-ignition may result in spurious sparks or flash-overs within the base. The dielectric strength of air is about 1 kV per millimeter. The spacing between current supply leads in the base of compact metal halide discharge lamps is small, however, and frequently in the order of about only 1 cm. Spurious discharges or flash-overs often start as creep discharges or creep arcs between the lamp connecting terminals, directly along the lamp bulb. The material of the lamp bulb or lamp vessel may, itself, increase the tendency to permit flash-over.

THE INVENTION

It is an object to provide a high-pressure discharge lamp in which arc-over or flash-over in the region of the base is prevented, by effectively preventing arc-over in air as well as creep or creep arcing discharges directly on the lamp vessel without essentially increasing the manufacturing costs of the lamp or the complexity of its manufacture.

Briefly, a compressible insert padding of a material which is characterized by high temperature resistance and high dielectric strength is fitted between the end portion of the lamp bulb and a base, at least in the region between the terminal leads of the lamp, the padding material filling the space between the terminal end of the bulb and the inner wall of the reception cup for the bulb in the base and fitting snugly against the end portion of the bulb. Preferably, the padding utilizes a fiber web or pile or fleece or mat, utilizing ceramic fibers as the fibrous material.

In accordance with a feature of the invention, the lamp can be easily made by inserting a disk or small pad of the fibrous web, pile or fleece material, typically ceramic pile or matting, within the cup-shaped region of the base. The lamp is then oriented with respect to the base, and the lamp and base are pressed against each other, thereby, at least in part, compressing the fibrous mat or pad, and reducing its thickness. The lamp is then secured in the base, retaining the mat in compressed condition.

The arrangement and the method of constructing the arrangement has the substantial advantage that the spacing between the connecting leads from the lamp bulb can be low, while still permitting reliable hot re-ignition with substantial voltage pulses. The insert padding not only prevents arc-over or flash-over of the pulse between the current supply leads, but additionally effectively inhibits a creep discharge along the end portion of the lamp bulb.

Various types of materials are suitable for the fibrous insert. A fibrous pile, web or fleece or mat is particularly preferred using, for example, quartz-glass wool, glass wool or ceramic fibers. The loose structure of the material and the intimately intermixed fibers increase any possible discharge path between the current supply leads, and, additionally, due to the compressibility, permits precise matching of the fiber mat or pad against the end of the lamp vessel, although this end does not have a defined surface. Typically, the end portion of the lamp vessel is formed by a pinch or press seal, and thus will have an irregular shape.

Fiber mats or pads made of quartz, glass or ceramic fibers, additionally resist deterioration under high operating temperatures, which may occur in the region of the base. Change in volume, due to temperature increase, within the region of the base does not affect the matching of the fibrous pad, due to the elastic characteristics of the fibrous pad; the elastic characteristic with ceramic, quartz or glass fibers, is not essentially impaired by high temperatures or changes in temperatures. Use of a fiber pile pad or mat made of ceramic fibers has additional advantages in handling and placement of a pad, which is simple and can be carried out mechanically. High voltage resistance, that is, resistance against arc-over, flash-over or creep current, thus is combined with inexpensive manufacture.

A padding of ceramic or glass fiber material can be easily inserted in a cup-shaped base, and the insertion can be readily integrated in the well known sequential steps in manufacture of lamps and in attaching a base structure to a bulb structure. Practically no additional time is required for insertion of the pad. The working step of fitting the lamp bulb to the base, and pressing the lamp bulb into the base, is utilized at the same time to compress the insert pad and thus further increase the resistance to arc-over or flash-over.

DRAWING

The single FIGURE is a front view of a high-pressure metal halide discharge lamp utilizing the present invention.

DETAILED DESCRIPTION

The FIGURE shows a preferred embodiment of a metal halide discharge lamp 1 of small power rating, that is, in the order of between 35 to 150 W. The overall length of such a lamp is about 8½ cm, with an outer maximum diameter of about 3 cm. The lamp has an inner bulb or discharge vessel 2 formed, usually, of quartz glass or the like, and retaining two electrodes 3, 4. It is filled with a fill of metal halides, a noble gas, and a small quantity of mercury. The two electrodes 3, 4 are connected to shafts 5, 6 which are sealed in the bulb vessel by pinch seals surrounding foils, typically molybdenum foils. The construction of the lamp vessel 2 is standard, and any suitable construction may be used.

The discharge vessel 2 is held in position by the supply wires 7, 8 located within a single-ended pinch-sealed outer bulb 9. The space between the discharge vessel 2 and the outer bulb 9 is evacuated. Both the discharge vessel 2 and the outer bulb 9, preferably, are made of quartz glass, although the outer bulb 9 may be made of hard glass under some conditions. The end portion 10 of the outer bulb 9 is sealed by a press or pinch seal 10*a*. External current supply leads 11, 12 are connected to molybdenum foils within the pinch or press seal in the end portion 10. The inner current supply leads 7, 8 form the electrical connection between the electrode shafts 5, 6 of the discharge vessel 2 and the external current supply leads 11, 12 as well as the mechanical support between the discharge vessel 2 and the outer bulb 9. The spacing of the outer current supply leads 11, 22 from each other is in one standard construction 12 mm.

A base 14 of ceramic surrounds the end portion 10 of the outer bulb 9 in the region of the pinch seal 10*a* terminating the bulb 9. The base 14 is formed with an inner reception region or cup 13 defined at the bottom by a bottom wall 15. The outer current supply leads 11, 12 are electrically and mechanically connected to terminal pins 16, 17, for example by soldering.

In accordance with a feature of the invention, a padding of fiber web, pile, fleece or mat is placed between the end portion 10 of the outer bulb 9 and the interior wall 15 of the cup-shaped receiving region 13 of the base 14. The insert 18, formed as a ceramic fleece or pile 19, fills the entire space between the bottom wall 15 and the end 10 of the outer bulb 9 of the lamp, as best seen in the drawing. The pad 19 should extend at least between the connecting leads 11, 12 extending from the bulb 9 but, preferably, extends also slightly around the side wall or the curved portion of the cup-shaped reception opening 13 of the base, as shown in the drawing.

Method of manufacture of the lamp:

A large supply web or sheet of the fiber pile, fleece, felt, or mat, having a thickness of about 3 mm, is provided from which a pad 19 of about 6 mm×20 mm, corresponding to the dimensions of the bottom wall 15 will be cut, for example by a punching operation. This insert is placed in the cup portion 13 of the base 14. A basing apparatus is placed in position with the leads 11, 12. The lamp bulb 9, with the leads 11, 12 extending therefrom, is moved towards the opening 13 of the base 14, to fit the base 14 over the aligned centered lamp bulb 9. The loose structure of the pad 19 does not require the formation of special bores or openings for the current supply leads 11, 12. The engagement pressure of the base 14 against the bulb 9 can readily be controlled by providing a resilient spring engagement and controlling the spring pressure. The spring is so dimensioned that a resulting force of at the most about 15N will result. This compresses the thickness of the pad 19 to about 1.1 mm. The resulting flash-over resistance voltage will be 26 kV.

The table below illustrates the relationship between flash-over resistance voltage $U_D$ in kilovolts, reduced thickness $d_r$ of the padding, as a function of engagement force K in Newtons (N). The relationships are of importance since the pinch processes resulting in the pinch seal 10*a*, terminating in the bottom 10 of the bulb 9, result in an irregular shape of the end portion 10 of the outer bulb. Consequently, tolerances will occur which are unavoidable, and the maximum length of the bulb 9, from the farthest point of the end 10 to the tip, cannot be accurately defined. Upon insertion, tolerances in the reduced thickness of the padding may occur which will be in the order of about 100%, corresponding to a reduced thickness $d_r$ of the padding of more than 2 mm.

Ignition voltages for hot re-ignition of compact metal halide lamps in the preferred embodiment are between 15 to 20 kV, depending on the lamp power rating, which may be between 35 to 150 W. In a worst case, that is, reduction of the original thickness of the pad from 3 mm to a thickness of $d_r$ of only 2.4 mm, occurrence of flash-over or arc-over or creep discharges is already inhibited, see the table below.

The ceramic pad 19 effectively inhibits flash-over in a free air space between the end of the lamp and the base structure 14 itself, and thus effectively prevents flash-over. In addition, due to its loose and compressible structure, and the resulting capability to fit against and hug an engaging surface, and the resulting and retained elasticity, the base 14 can readily be fitted with compressive force against the irregular end 10 of the outer bulb 9, while maintaining a tight engagement. This is particularly important because, frequently, upon forming a pinch seal, pinch grooves will occur between the current supply connections 10, 11. The pad 19 effectively fills such a groove or channel along which spurious surface creep discharge usually occur. The padding, by engaging and filling and fitting into the groove, thus, prevents such creep discharges. The elasticity of the pad 19 further effectively fills the space between the bulb 9 and the walls of the base 14 even if the space should change slightly upon heating of the lamp, which may cause the base 14 to spread farther than the lateral extension of the lamp. Yet, the elasticity of the compressed pad will fill the intervening space to prevent spurious discharges.

It has been found that fibrous webs, fibrous piles, fibrous fleece or fibrous mat structures are best, particularly if made of quartz-glass, glass or ceramic fiber. Other materials of lesser deformability and elasticity, such as ceramic paper, have been found substantially less suitable for the purpose or for inserts.

The present invention is not restricted to high-pressure discharge lamps as shown in the FIGURE. Particularly the ignition characteristics of metal halide lamps without an outer bulb, in which the discharge vessel is directly based, can be improved by providing a pad insert as described. The invention is equally applicable to other types of high-pressure discharge lamps, such as sodium high-pressure discharge lamps and, in short, various types of discharge lamps in which high-voltage insulation between closely spaced terminals is of importance.

The base structure 14 is attached to the lamp bulb 9 above the pad 19 by any suitable cement, as well known.

| K (N) | $d_r$ (mm) | $U_D$ (kV) |
|---|---|---|
| 3 | 2.4 | 22 |
| 7 | 1.8 | 25 |
| 14 | 1.1 | 26 |

wherein

K (N) is the compressive force in Newtons $d_r$ is the reduced compressed thickness of pad 19

$U_D$ is the dielectric resistance voltage or flash-over resistance voltage $U_D$. Starting, uncompressed, thickness of pad 19: 3 mm.

We claim:

1. Single-ended high-pressure discharge lamp (1) having a lamp bulb (9) having a terminal end (10);

two terminal leads (11, 12) passing through said terminal end outside of the bulb;

a base (14) formed with a terminal end reception cup means (13), said reception cup defining an inner wall, comprising a compressible insert padding (18) of a material which is characterized by high temperature resistance and high dielectric strength, tightly engaging the lamp bulb (9) at least in the region between the terminal leads (11, 12) and filling the space between the terminal leads (11, 12) and the terminal end (10) of said bulb and the inner wall (15) of the reception cup (13) of the base (14); and means for securing the lamp bulb (9) to the base (14) in a region of said reception cup (13) away from said terminal end and remote from said insert padding (18).

2. The lamp of claim 1, wherein said compressible insert padding comprises a fibrous web, fibrous pile, fibrous fleece or fibrous mat.

3. The lamp of claim 2, wherein the fibers of the fibrous web, pile, fleece or mat comprise ceramic fibers.

4. The lamp of claim 2, wherein the fibers of the fibrous web, pile, fleece or mat comprise quartz or glass fibers.

5. The lamp of claim 2, wherein said terminal end (10) comprises a pinch or press seal (**10*a***) defining an irregular end surface;

wherein said compressible insert padding is located in the entire space between the entire bottom wall portion (15) of the reception cup (13) of the base (14) and said irregular surface of the terminal end (10) of the bulb (9), and said padding is under force-compressed condition, retained in said space by a compressive force exerted by the bulb against said base.

6. The lamp of claim 5, wherein said terminal leads (11, 12) are tightly engaged around by said compressible insert pad (19) and punched through said fibrous compressible insert pad.

7. High-pressure discharge lamp (1) having a bulb (9) having a terminal end (10);

at least one terminal lead (11, 12) passing through said terminal end outside of the bulb;

a base (14) formed with a terminal reception cup (13); and comprising, in accordance with the invention, a compressible insert padding (18) of fibrous material made of high temperature resistant, high dielectric strength fibers tightly engaged and compressed between the terminal end (10) of said bulb and a bottom wall (15) of said reception cup (13) in the base, and filling the entire space between said bulb and the bottom wall of the reception cup.

8. The lamp of claim 7, wherein the fibrous padding comprises a pad (19) of ceramic, quartz, or glass fibers formed in a fibrous web, fibrous pile, fibrous fleece or fibrous mat.

9. Method of making a high-pressure discharge lamp as claimed in claim 7, said lamp having a terminal end (10), two terminal leads (11, 12) passing through said terminal end outside of the bulb, a base (14) formed with a reception cup (13) and defining a bottom wall (15) within the cup, comprising the steps of providing a fibrous web, pile, fleece or mat material;

severing from said material a portion of predetermined thickness to provide an insert pad (19);

fitting the insert pad into the reception cup of the base;

orienting the lamp with respect to the base;

moving the lamp base and the lamp bulb towards each other, and at least partially compressing the pad (19), thereby reducing its thickness until a design length of the lamp bulb and base is obtained;

and attaching the lamp bulb to the base.

10. The method of claim 9, wherein the lamp bulb (9) is terminated in a pinch or press seal (**10*a***);

and said compression step comprises tightly engaging and fitting the fibrous pad (19) against the pinch or press seal.

11. The method of claim 9, wherein the step of moving the base and the lamp bulb towards each other includes the step of pushing the terminal leads through the fibrous pad insert and through openings formed in the base (14) for reception of said terminal leads, said step of pushing the terminal leads forming, in said operation, a path for said terminal leads into said base without preforming openings for said terminal leads.

* * * * *